United States Patent [19]

Moeller

[11] 4,343,266

[45] Aug. 10, 1982

[54] PIG HOLDING DEVICE

[76] Inventor: Brian J. Moeller, R.R. 1, Somers, Iowa 50586

[21] Appl. No.: 218,216

[22] Filed: Dec. 19, 1980

[51] Int. Cl.[3] ..... A61D 3/00

[52] U.S. Cl. ..... 119/98

[58] Field of Search ..... 119/96, 98, 103; 17/44.2, 44.3; 269/322, 328

[56] References Cited

U.S. PATENT DOCUMENTS

| | | | |
|---|---|---|---|
| 3,092,079 | 6/1963 | Strebel et al. | 269/328 X |
| 4,059,869 | 11/1977 | Dunstheimer | 119/103 X |
| 4,213,424 | 7/1980 | Hosch et al. | 119/98 |

FOREIGN PATENT DOCUMENTS

| | | | |
|---|---|---|---|
| 115926 | 10/1942 | Australia | 119/103 |
| 214414 | 4/1958 | Australia | 119/98 |

*Primary Examiner*—Gene Mancene
*Assistant Examiner*—Robert P. Swiatek
*Attorney, Agent, or Firm*—Zarley, McKee, Thomte, Voorhees & Sease

[57] ABSTRACT

The pig holding device of the present invention comprises an upstanding stand having two different holding devices mounted thereon. One of the holding devices comprises a pair of upstanding Y-shaped forks. The forward fork is adapted to embrace the pig around its neck behind the ears and the rearward Y-shaped fork is adapted to embrace the flanks of the pig immediately forwardly of the pig's rear legs. The pig's feet are suspended above the supporting surface so that the pig's weight is supported by the forward and rearward Y-shaped forks. The second holding device comprises a pair of V-shaped members which have their V-shaped apexes pointing downwardly and toward one another. Each of the pig's hind legs is inserted into one of the V-shaped members so that the pig is suspended in a vertical position with his head down. The V-shaped configuration of the members causes the pig's legs to be grasped therein in response to the downward force of gravity on the pig.

4 Claims, 6 Drawing Figures

PIG HOLDING DEVICE

BACKGROUND OF THE INVENTION

This invention relates to devices for holding young pigs so that certain operations can be performed thereon.

Numerous operations must be performed on young pigs in order to insure their health and in order to make pork production more efficient. For example, it may be desirable to clip the young pig's needle teeth, to notch his ears, to tag them, to vaccinate them, to castrate them, to dock their tails and other similar operations.

One problem encountered in trying to perform the above operations is that pigs are difficult to hold and control during the time that the operations are being performed. Various types of holding devices have been provided, but these devices are often cumbersome and awkward to work with.

Therefore, a primary object of the present invention is the provision of an improved device for holding pigs during such operations as clipping needle teeth, notching ears, tagging, vaccinating, castrating, docking the tail and other similar operations.

A further object of the present invention is the provision of a device which permits quick insertion and removal of the pig so as to permit a large number of pigs to be handled in a short period of time.

A further object of the present invention is the provision of a device which does not rely upon caging or enclosing the animal, but instead exposes the parts of the animal's body for quick and efficient accomplishment of the desired operation.

A further object of the present invention is the provision of a device which keeps the pig's feet off a supporting surface so that he cannot wriggle away during the time that he is being worked upon.

A further object of the present invention is the provision of a device which can be adjusted easily to accommodate various sized pigs.

A further object of the present invention is the provision of a device which utilizes a minimum number of moving parts.

A further object of the present invention is the provision of a device which increases its hold upon the animal the more the animal wriggles and tries to get away.

A further object of the present invention is the provision of a device which holds the animal while at the same time preventing injury to the animal.

A further object of the present invention is the provision of a device which is portable and easy to move.

A further object of the present invention is the provision of a device which is durable, economical to manufacture, and efficient in operation.

SUMMARY OF THE INVENTION

The present invention utilizes a stand having two pig holding devices mounted thereon. One of these pig holding devices comprises forward and rearward Y-shaped forks which are adapted to embrace the pig therebetween. The pig's neck is placed within the forward Y-shaped fork and the flanks of the pig are placed between the Y arms of the rearward fork. The height of the forks is sufficient that the pig cannot touch the supporting surface with his feet. Thus, as the pig struggles, he tends to move downwardly within the Y-shaped arms of the forward and rearward forks, thereby increasing the tightness with which he is held by the forks. It has been found that the pigs cannot escape the forks no matter how much they struggle, and furthermore, since they cannot touch the supporting surface with their feet, they cannot escape the operator's hands as he performs the various functions needed.

A second holding device is provided for holding the pig during the vaccination and castration. The second holding device comprises two V-shaped members, which have their V-shaped apexes pointed downwardly and toward one another. Each of the pig's hind legs is inserted into one of these V-shaped members so that the elbow joint of the pig's rear leg is positioned above the V-shaped member and so that the pig is suspended downwardly therefrom. The weight of the pig forces the pig's legs towards the V-shaped centers, thereby causing the V-shaped members to grasp the pig more tightly so that he cannot escape.

In order to accommodate pigs of various sizes, the rear Y-shaped fork member is adapted to pivot about a horizontal axis so that it can be moved rearwardly with respect to the forward Y-shaped fork member. This increases the distance between the two so that the device can accommodate pigs of varying lengths.

The V-shaped holding devices are also adjustable so that they can be moved toward and away from one another to accommodate pigs of varying sizes. It has been found that the present device can accommodate pigs between five and 40 pounds.

DETAILED DESCRIPTION OF THE PREFERRED EMBODIMENT

Figure 1:
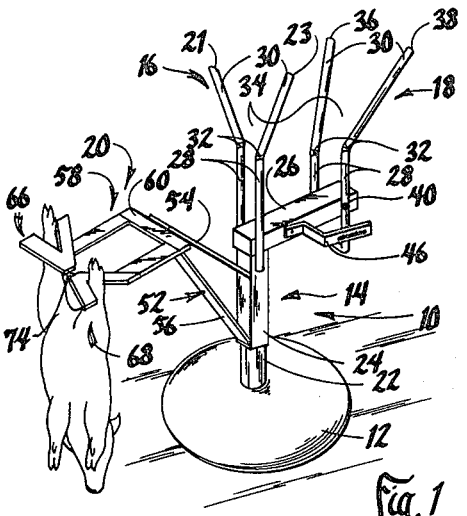
FIG. 1 is a perspective view of the device of the present invention.

Referring now to the drawings, the numeral 10 generally designates the pig holding device of the present invention. Device 10 comprises a pedestal 12, an upstanding frame assembly 14, a forward Y-shaped fork member 16, a rearward Y-shaped fork member 18, and a hanger assembly 20 for suspending the pig in an inverted position. Pedestal 12 includes an upstanding stem 22 which is telescopically received within a vertical tube 24. Frame assembly 14 also includes a horizontal frame member 26 welded to the upper end of vertical tube 24 and extending rearwardly therefrom.

Forward Y-shaped fork 16 comprises two fork members 21, 23 each of which has a lower vertical portion 28, an upper spreading portion 30 and a juncture 32 therebetween. The lower ends of vertical portions 28 are welded or otherwise attached to the opposite sides of vertical tubes 24, so that they are in vertical spaced apart relationship. The upper spreading portions 30 diverge from one another. Thus, a narrowed area 34 is provided at the lower ends of spreading portions 30 adjacent junctures 32.

Rearward fork assembly 18 comprises a pair of fork members 36, 38 which are similar in construction to fork members 21, 23. Accordingly, corresponding numerals are used to designate the portions thereof. One difference between forward and rearward fork assemblies 16 and 18 is that the upper spreading portions 30 of rearward fork assembly 18 angle in a plane which extends rearwardly from juncture 34. In contrast, the spreading portions 30 of forward fork assembly 16 remain in the same vertical plane as lower portions 28. This contrast can be readily seen in FIG. 2.

A hinge pin 40 pivotally connects the lower ends of lower portions 28 of rear forks 18 to horizontal frame member 26. This permits forks 18 to pivot rearwardly about a horizontal axis in the direction shown by arrow 42. Lower portions 28 of rear fork members 36, 38 protrude a short distance below horizontal frame 26 and include a wing nut 44 thereon for retentively engaging a locking link 46. Link 46 is pivoted at one end 48 to horizontal frame 26 and includes a slot 50 adapted to receive wing nut 44. Thus, the tilted position of rear Y-shaped fork 18 can be adjusted and locked by means of link 46 and wing nut 44.

Figure 4:
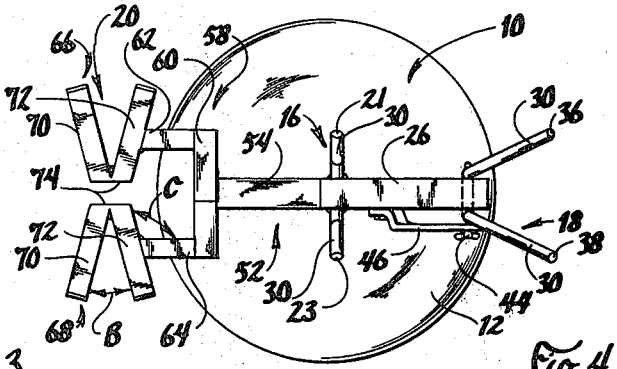
FIG. 4 is a top plan view of the device.

A truss frame 52 comprising truss members 54, 56 is secured at one end to vertical tube 24 and extends upwardly and forwardly therefrom. Fixed to the upper end of truss frame 52 is a U-shaped frame 58 having a cross member 60 and two leg members 62, 64 (FIG. 4). The U-shaped frame 58 is held in a substantially horizontal plane in spaced relation above the support surface on which device 10 rests.

Mounted at the forward ends of legs 62, 64 are a pair of V-shaped members 66, 68, each of which comprises a pair of V-legs 70, 72 which converge at an apex 74.

V-shaped members 66, 68 are fixed in a position wherein they extend downwardly and inwardly toward one another with their V-shaped apexes 74 being in close, but spaced, relationship. The angle A between the horizontal plane of U-shaped member 58 and the planes of V-shaped members 66, 68 is preferred to be approximately 40°, but can vary plus or minus 5° without detracting from the invention. The angle B between V-legs 70, 72 is preferred to be 25°, but also can vary plus or minus 5° without detracting from the invention.

The angle C between the V-legs 72 and the legs 62, 64 of U-shaped frame 58, is preferred to be approximately 100°, but can vary plus or minus 5° without detracting from the invention.

Figure 2:
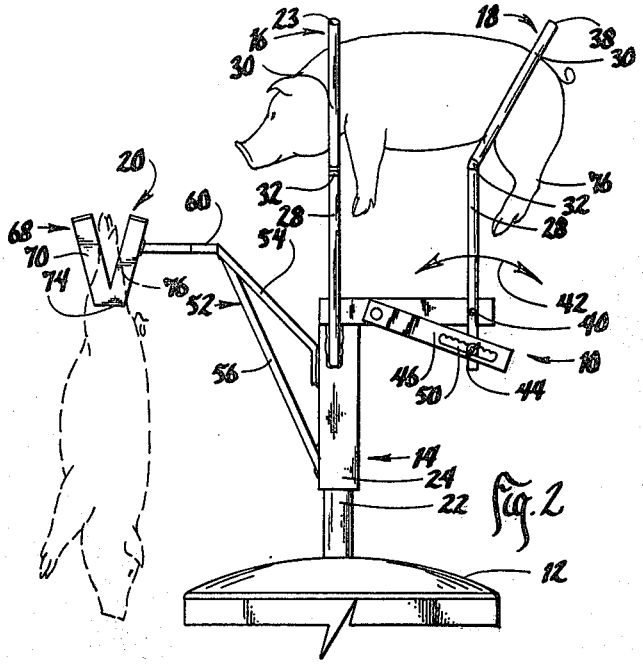
FIG. 2 is a front elevational view of the device.
Figure 3:
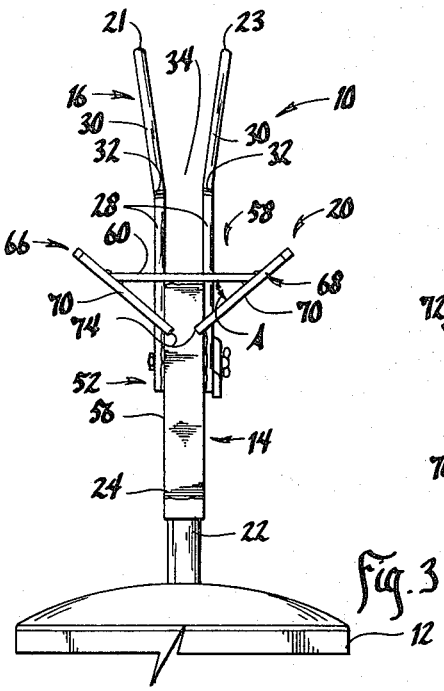
FIG. 3 is an end view of the device.

In operation, the pig is placed with his neck between the Y-shaped spreading portions 30 of fork 16 as shown in FIG. 2. Similarly, the spreading portions 30 of Y-shaped fork 18 are placed on opposite sides of the pig's flank adjacent the pig's rear legs. Vertical portions 28 of both forks 16 and 18 are sufficiently long that the pig's feet are suspended above horizontal frame 26 and above any other supporting structure. Thus, the pig's entire weight is borne by the forks 16 and 18. The pig cannot reach any supporting surface with his feet, and therefore is rendered helpless and unable to escape. The more he struggles, the further his weight is forced downwardly in the Y-shaped spreading portions 30 of forks 16 and 18, and consequently, he is held tighter the more he struggles. While this structure has been found to hold the pig securely, it has also been found not to harm him in any way.

For some operations, it is desirable to hold the pig in a vertical inverted position. Hanger assembly 20 is used for this purpose. The pig's rear legs are inserted one at a time into the V-shaped members 66, 68 with the elbow joint of the pig's rear legs positioned above V-shaped members 66, 68. The weight of the pig causes the legs to slide downwardly toward the V-shaped apexes 74 of the V-shaped members 66, 68, thereby causing the pig's legs to be held tightly so as to prevent them from coming loose. The pig is held securely for castration and for vaccination.

Figure 6:
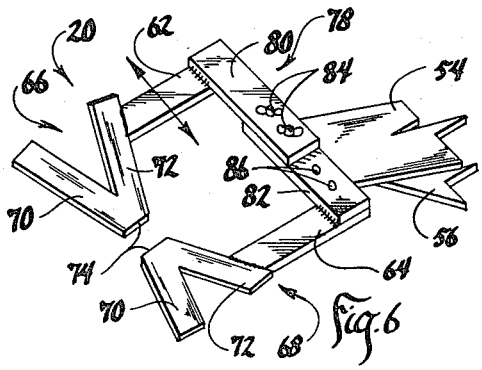
FIG. 6 is a partial perspective view of a modified form of the invention.
Figure 5:
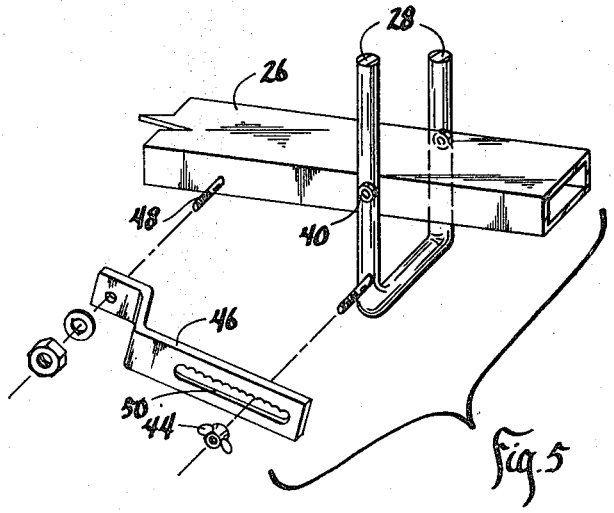
FIG. 5 is a partial perspective view showing the hinged connection of the rear fork plate to the stand.

Referring to FIG. 6, a modified form 78 of the hanger assembly is shown. Assembly 78 is identical to assembly 20 with the exception that the cross member 60 of assembly 20 is replaced with a pair of cross members 80, 82 which are longitudinally slidable with respect to one another and which are locked together by means of wing nuts 84. A plurality of apertures 86 are provided in members 80, 82 so that their relative longitudinal positions may be adjusted by releasing wing nuts 84, sliding the members 80, 82 to the desired position and by reinserting and tightening wing nuts 84. This permits the adjustment of the relative distance between apexes 74 of V-shaped members 66, 68 so as to accommodate pigs of varying sizes.

It has been found that the device of the present invention will accommodate pigs ranging from 5 to 40 pounds. The device permits the holding of pigs during such operations as clipping needle teeth, notching ears, tagging, vaccinating, castrating, docking the tail and similar other operations. The pig may be inserted quickly into either of the two devices, and removed quickly so as to permit a large number of pigs to be handled in a short period of time. There is no caging or enclosing of the animal, and therefore the animal's anatomy is exposed for the various operations which must be performed. The pig's feet are held off any supporting surface, and therefore he cannot wriggle away during the time that he is being worked upon. Any wriggling results in the pig being held more tightly.

The device can be adjusted easily to accommodate varying sized pigs. There are a minimum number of moving parts in the device, and the device minimizes any chances of injury to the animal. Thus, it can be seen that the device accomplishes at least all of its stated objectives.

What is claimed is:

1. A device for holding a pig above a support surface, comprising:

a spaced apart pair of upstanding forward fork members, each having a lower end and an upper end, said upper ends of said forward fork members being spaced apart a first distance greater than the diameter of said pig's neck, said forward fork members converging toward one another at a forward narrowed portion located intermediate said upper and lower ends, said narrowed portion being of a width substantially less than said diameter of said pig's neck, a spaced apart pair of upstanding rear fork members each having upper and lower ends, said upper ends being spaced apart a second distance greater than the flank width of said pig adjacent its rear legs, said rearward fork members converging toward one another at a rearward narrowed portion located intermediate said upper and lower ends, said narrowed portion having a width substantially less than said flank width of said pig;

frame means interconnecting said forward and rearward fork members at a point spaced a predetermined third distance below said forward and rear narrowed portions, said third predetermined distance being sufficiently great to cause said pig's feet to be suspended above said frame means when said pig is grasped between said fork members with said forward fork members embracing said pig's neck and said rearward fork members embracing said pig's flanks forwardly of its rear legs;

said rear fork members each including a substantially vertical portion extending downwardly from said narrowed portion and an angled portion extending upwardly from said narrowed portion and rearwardly away from said forward fork members;

hinge means pivotally connecting said rear fork members to said frame means for hinged movement about a horizontal axis;

lock means associated with said hinge means for permitting selective locking and holding of said rear fork members against pivotal movement about said horizontal axis.

2. A device according to claim 1 further comprising a U-shaped frame having a cross member and two leg members, support means interconnecting said frame means and said U-shaped frame, said support means holding said U-shaped frame in approximately a horizontal plane spaced above said support surface;

a pair of V-shaped members, each being fixed to one of said leg members of said U-shaped frame, and each having two V-legs joined at a V-apex;

said V-apexes of said V-shaped members pointing toward one another, said V-members being disposed at an angle of approximately 40° with respect to horizontal with said V-apexes pointing downwardly;

the angle between said V-legs of each V-shaped member being between 20° and 30°;

said V-shaped members being sized to receive and grasp the rear legs of said pig and hold said pig by said rear legs in upside down position.

3. A device for holding a pig above a support surface comprising:

a U-shaped frame having a cross-member and two leg members;

support means connected to said U-shaped frame and holding said U-shaped frame in approximately a horizontal position suspended in spaced relation above said support surface;

a pair of V-shaped members, each being fixed to one of said leg members of said U-shaped frame, and each having two V-legs joined at a V-apex;

said V-apexes of said V-shaped members pointing toward one another;

said V-members being disposed at an angle of approximately 40° with respect to horizontal with said V-apexes pointing downwardly;

the angle between said V-legs of each V-shaped member being between 20° and 30°;

said V-shaped members being sized to receive and grasp the rear legs of said pig and hold said pig by said rear legs in upside down position.

4. A device according to claim 3 wherein said cross member of said U-shaped frame comprises two elongated members in registered longitudinal alignment with one another, detachable securing means holding said elongated members together, said securing means being detachable to permit longitudinal extension of said elongated members with respect to one another so as to permit selective adjustment of the distance between said V-shaped members.

* * * * *